United States Patent [19]

Terada et al.

[11] Patent Number: 4,976,120

[45] Date of Patent: Dec. 11, 1990

[54] SLIDER LOCK ASSEMBLY

[75] Inventors: Yasuharu Terada, Uozu; Yoshiyuki Horita, Toyama; Susumu Ishii, Kurobe; Kiyoyasu Wake, Kawaski, all of Japan

[73] Assignee: Yoshida Kogyo K. K., Tokyo, Japan

[21] Appl. No.: 426,763

[22] Filed: Oct. 26, 1989

[30] Foreign Application Priority Data

Dec. 14, 1988 [JP] Japan ..... 63-317007

[51] Int. Cl.[5] ..... E05B 67/38

[52] U.S. Cl. ..... 70/68; 70/312

[58] Field of Search ..... 70/23, 67, 68, 312

[56] References Cited

U.S. PATENT DOCUMENTS

| | | | |
|---|---|---|---|
| 2,741,114 | 4/1956 | Poux | 70/68 |
| 4,015,457 | 4/1977 | Fukuroi | 70/68 |
| 4,221,027 | 9/1980 | Oda | 70/68 X |
| 4,244,086 | 1/1981 | Gregg | 70/68 X |
| 4,395,891 | 8/1983 | Remington | 70/68 |
| 4,514,884 | 5/1985 | Kaneko | 70/68 X |
| 4,884,419 | 12/1989 | Ling | 70/312 X |
| 4,930,323 | 6/1990 | Terada et al. | 70/68 |

FOREIGN PATENT DOCUMENTS

| | | | |
|---|---|---|---|
| 1412871 | 8/1965 | France | 70/68 |
| 2527909 | 12/1983 | France . | |
| 54-35764 | 10/1979 | Japan . | |
| 1477290 | 6/1977 | United Kingdom . | |
| 2085071 | 4/1982 | United Kingdom . | |

*Primary Examiner*—Gary L. Smith
*Assistant Examiner*—Suzanne L. Dino
*Attorney, Agent, or Firm*—Hill, Van Santen, Steadman & Simpson

[57] ABSTRACT

A slider lock assembly is disclosed, comprising a pair of male slider and female slider releasably coupled together by a lock tumbler pivotally mounted in a casing, the male slider having an integral extension with a lock cavity engageable with the lock tumbler. The lock tumbler is both rotatable and linearly moveable and operatively associated with dial device or a key-operated latch so that the two sliders can be coupled together selectively in a provisionally locked state or in a completely locked state.

10 Claims, 7 Drawing Sheets

SLIDER LOCK ASSEMBLY

BACKGROUND OF THE INVENTION

1. Field of the Invention

This invention relates to sliders for slide fasteners, more particularly a pair of sliders incorporating lock mechanisms to lock themselves together on a slide fastener applied to garment articles.

2. Prior Art

Slide fasteners have heretofore have found wide application on a variety of garment articles such as clothing, bags, tents, suitcases and the like. There were many instances where sliders were used desirably in a pair on a single fastener, in which instance they were locked together immediately upon head-on coupling and unlocked with use of a change key or a dial combination. A typical example of such paired slider lock is disclosed in Japanese Utility Model Publication No. 54-35764 in which one of the sliders is provided at its front end with a plug member engageable with a socket member in the other slider having a lock pin operatively associated with a latch or lock tumbler and engageable with the plug member for locking the two sliders together which can be unlocked or separated by the use of a change key.

With a slide fastener used on a bag or suitcase in transit, it is not always necessary to lock its sliders but it is rather preferred to keep the sliders coupled together without being fully locked The aforementioned prior art slider lock is not suitable for such application because the two sliders become automatically locked immediately upon being interengaged. If the sliders were drawn toward each other closely but halfway of their lock position, they would tend to move out of place to inadvertently open the fastener.

SUMMARY OF THE INVENTION

It is therefore the primary object of the present invention to provide an improved slider lock for a slide fastener which is simple in construction and efficient in operation to ensure at option "complete" or "provisional" locking of the slide fastener.

More specifically, the present invention is aimed at the provision of a slider lock assembly which incorporates means of retaining a slide fastener in closed disposition with a pair of sliders held in interconnected but unlocked condition under the influence of normal external stresses and allowing the slide fastener to open simply by pulling one of the sliders away from the other unless they are positively locked together The above and other objects and features of the invention will be more apparent from the following detailed description taken in conjunction with the accompanying drawings.

BRIEF DESCRIPTION OF THE DRAWINGS

In the drawings in which like reference numerals refer to like or corresponding parts throughout the several views.

DETAILED DESCRIPTION OF THE PREFERRED EMBODIMENT

Figure 4:
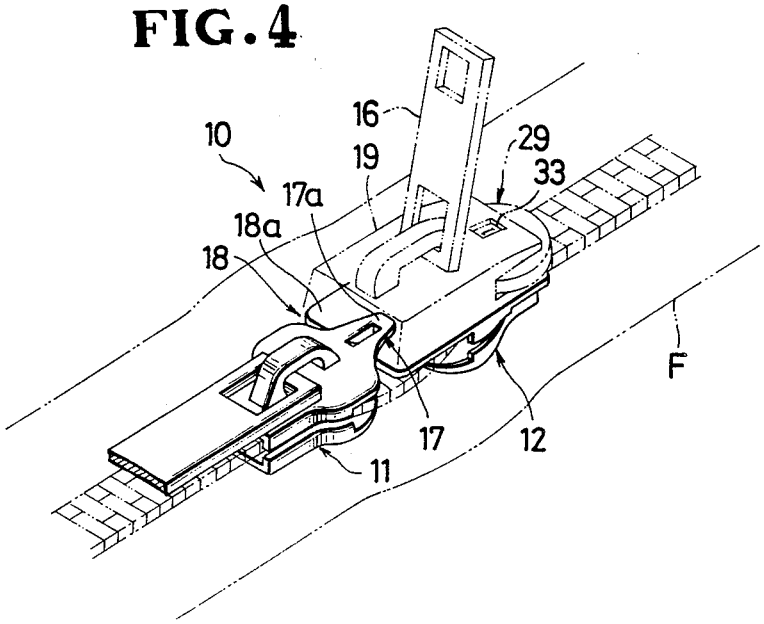
FIG. 4 is a view similar to FIG. 2 but showing the pair of sliders interconnected or coupled together.

Referring now to the drawings and FIG. 1 in particular, there is shown a slider lock assembly 10 which comprises a pair of sliders, one of which is referred to hereinafter as a male slider 11 and the other as a female slider 12. The two sliders 11 and 12 are conveniently used to open and close a slide fastener F (FIGS. 2 and 4) from either direction and can be brought into and out of locked engagement with each other, or alternatively retained in interconnected but unlocked relation in a manner hereafter to be described.

The male and female sliders 11 and 12 are similar in their basic construction in that they each have an upper wing 13 and a lower wing 14 joined together at one of their ends by a neck 15 which is commonly termed a "diamond" and defining therebetween a guide channel for the passage of the slide fastener F and a pull tab 16 adapted to move the slider along the slide fastener F.

The male slider 11 has a one-piece wing extension 17 tapered and extending forwardly of the neck 15 and having an upper surface **17*a* lying flush with the upper surface of the upper wing 13 and a lower surface 17*b* offset from the lower surface of the lower wing 14. The wing extension 17 has a lock cavity 17*c* formed in its upper surface 17*a* and cross-sectionally defined by an arcuate bottom wall 17*d* and a vertical end wall 17*e* at the leading end of the extension 17, the cavity 17*c* increasing in depth progressively toward the vertical wall 17*e*, as better shown in FIGS. 1 and 7. The wing extension 17 is provided at the lower leading end portion with an upwardly canted cam surface 17*f*** for purposes hereafter to be described.

The female slider 12 has a two-piece wing extension 18 consisting of an upper wing extension **18*a* and a lower wing extension 18*b* extending integrally from the upper wing 13 and the lower wing 14 respectively and forwardly of the neck 15. The upper and lower extensions 18*a* and 18*b* are in spaced parallel relation to each other, defining therebetween a guide opening 18*c* for receiving the wing extension 17 of the male slider 11**.

The upper wing extension 18*a* has an aperture 18*d* communicating with the guide opening 18*c*.

The neck 15 of the female slider 12 has a downwardly canted front end surface 15*a* disposed in the opening 18*c* for face-to-face engagement with the canted cam surface 17*b* of the male wing extension 17.

Designated at 19 is a casing encompassing and attached to the upper wing 13 of the female slider 12.

Figure 3:
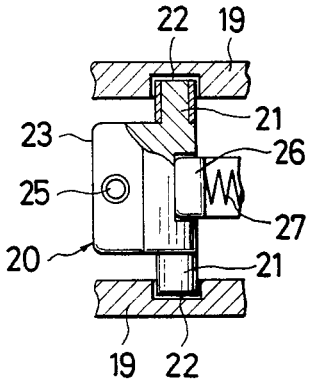
FIG. 3 is a top view, partly sectional, of a lock tumbler constituting part of the lock assembly of FIG. 1.

A lock tumbler or latch 20 is pivotally mounted through the aperture 18*d* in the casing 19 to enter into and retract from the guide opening 18*c* in the casing 19 of the female slider 12. More specifically, the tumbler 20 has an integral transverse pin 21 received in vertically elongated guide slots 22 formed in opposite side walls of the casing 19, as better shown in FIG. 3, so that the tumbler 20 can rotate and move vertically linearly as well along the guide slots 22. The lock tumbler 20 is provided at one end with an integral lock prong 23 shaped in conformity with and hence engageable with the lock cavity 17*c* of the male slider 11 with tight fit in a manner hereafter to be described. At the other end of the tumbler 20 is an integral abutment 24.

Figure 1:
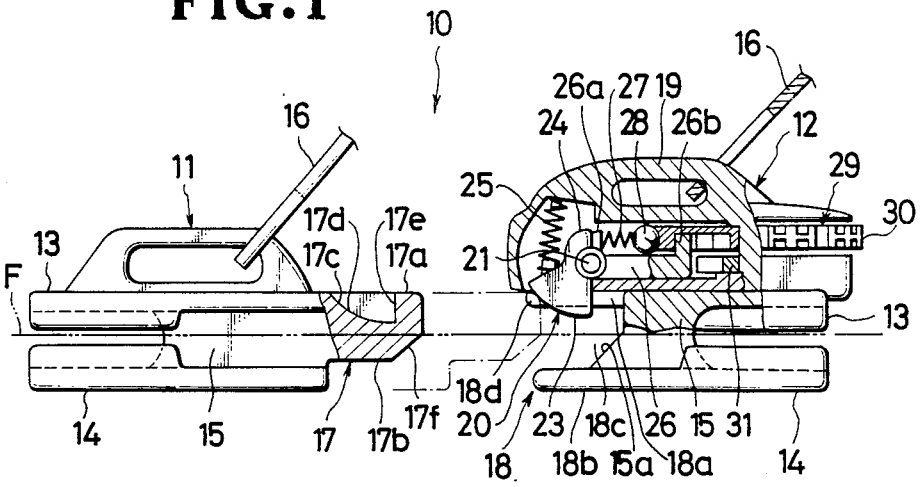
FIG. 1 is a side elevational, partly sectional view of a slider lock assembly embodied in a pair of sliders for a slide fastener.

The lock tumbler 20 is normally urged downwardly toward the guide opening 18*c* by means of a first compression spring 25 supported vertically in place within the casing 19 as shown in FIG. 1.

A slide bracket 26 has integral vertical ribs 26*a* and 26*b* protruding upwardly from opposite ends thereof and is mounted in the casing 19 horizontally movably above the upper wing 13 of the female slider 12. The bracket 26 is normally urged horizontally toward the tumbler 20 by means of a second compression spring 27 having one end connected to the ribs 26*a* and the other end connected via ball 28 to the periphery of a first dial later described.

Figure 2:
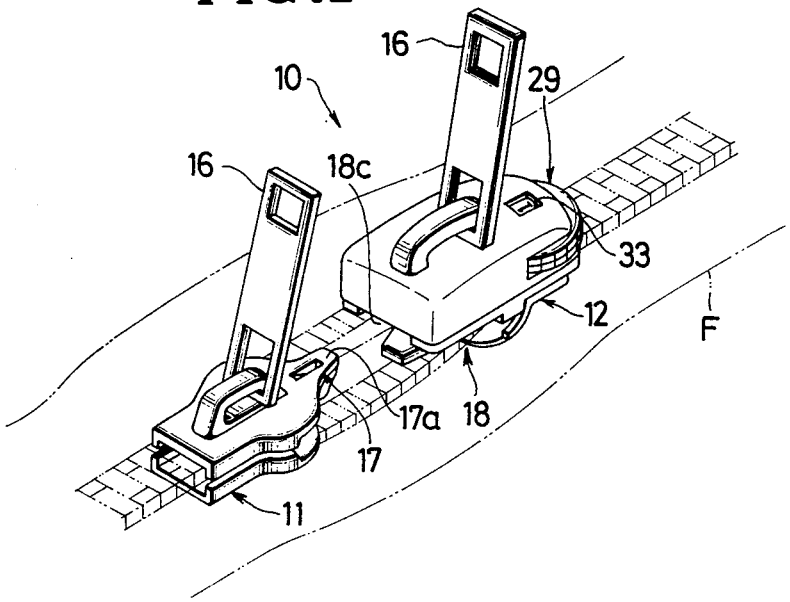
FIG. 2 is a perspective view of the pair of sliders of FIG. 1 shown mounted in separated relation on a slide fastener.

A dual dial device 29 comprises a first dial 30 and a second dial 31 disposed in superposed relation to each other and each rotatably mounted in the casing 19 and partly protruding from the rear end thereof remote from the lock tumbler 20. The first or upper dial 30 has a predetermined number of equally spaced peripheral grooves 32 engageable with the ball 28 connected to the second spring 27 so that the dial device 29 can rotate resiliently intermittently. The first dial 30 carries on its upper surface an array of indicia such as numerical figures which are successively exposed to view through a window 33 formed in the top wall of the casing 19 as the dial is rotated, as shown in FIG. 2.

The first and second dials 30 and 31 are rotatable relatively to each other by means of for example respective confrontable pins (not shown), and have engaging peripheral notches 30*a* and 31*a*, respectively, which are selectively engageable with the vertical rib 26*b* of the slide bracket 26.

Figure 5:
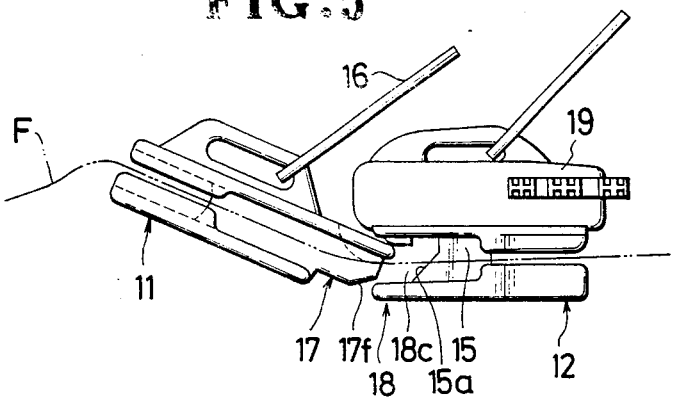
FIG. 5 is a side elevational view of the pair of sliders that are about to be coupled.
Figure 6:
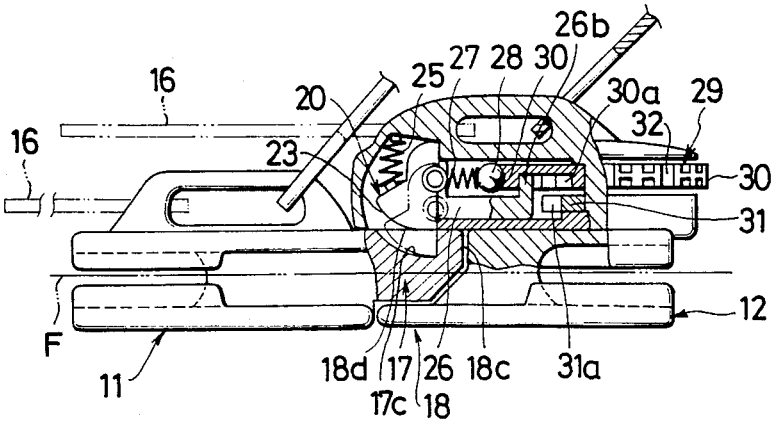
FIG. 6 is a side elevational, partly sectional view of the pair of sliders showing the same immediately upon being coupled but unlocked.
Figure 7:
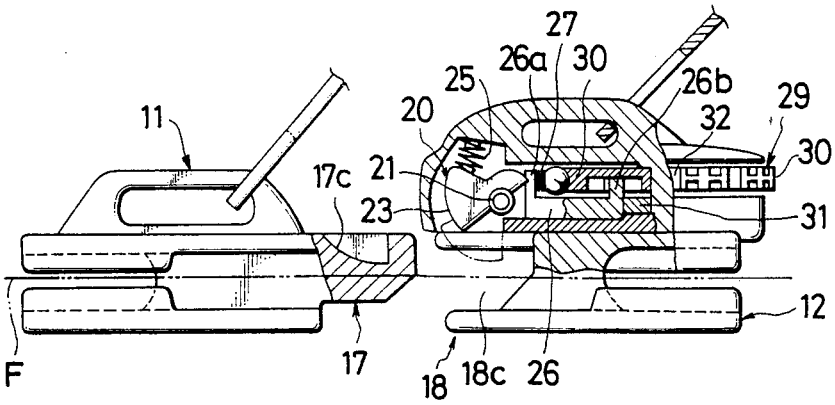
FIG. 7 is a view similar to FIG. 6 but showing the pair of sliders separated from each other.
Figure 8:
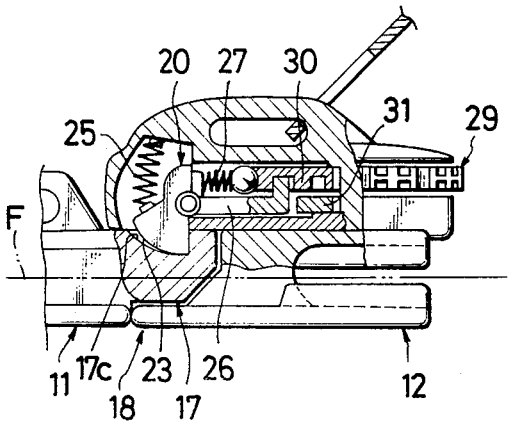
FIG. 8 is a view similar to FIG. 6 but showing the pair of sliders coupled and locked.

With this construction, the pair of sliders 11 and 12 are brought into coupling engagement with each other by, for instance, inserting the wing extension 17 of the male slider 11 into the guide opening 18*c* in the female slider 12 as shown in FIG. 5, in which instance, the male slider 11 is apt to tilt forwardly as it is pulled by the tab 16, and the cam surface 17*f* of the extension 17 moves in sliding engagement with the front end of the lower wing 14 of the female slider 12 and thus aids in smooth entry of the extension 17, while the lock prong 23 is lifted in contact with the leading upper surface portion of the extension 17 against tension of the first spring 25 and upon registry with the lock cavity 17*c*, the prong 23 is urged by the spring 25 downwardly into the cavity 17*c* as shown in FIGS. 6 and 8. When separating the thus coupled pair of sliders 11 and 12, they are pulled away from each other with a tensile strength great enough to overcome a compression strength of the spring 25 to release the lock prong 23 from the lock cavity 17*c*, in which instance the prong 23 is so released as the tumbler 20 rotates clockwise (as viewed in the drawings) on its pin 21 until the prong 23 is clear of the guide opening 18*c*, as shown in FIG. 7. Immediately upon departure of the male slider 11, the tumbler 20 is returned by the action of the spring 25 to its original position with the lock prong 23 protruding back into the guide opening 18*c*.

Figure 9:
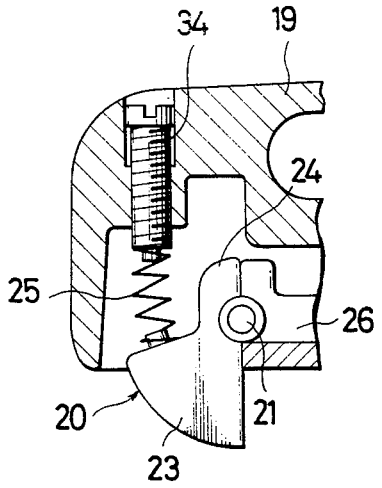
FIG. 9 is a cross-sectional view on enlarged scale of a modified form of part of the lock tumbler.

FIG. 9 shows the compression spring 25 connected to an adjustable screw 34 whereby the compression strength of the spring 25 can be varied in compliance with a particular need.

The dial device 29 is utilized to permit and prohibit movement of the lock tumbler 20 into and out of the guide opening 18*c*. In a typical mode of operation, the first dial 30 is rotated in either direction until a selected combination of indicia appears in the window 33 so that the engaging notch 31*a* of the second dial 31 registers with the rib 26*b* of the slide bracket 26, and the first dial 30 is then rotated in the opposite direction until another selected combination appears in the window 33 to bring the engaging notch 30*a* of the first dial 30 into registry with the rib 26*b*. This position represents "unlock" or "provisional lock" condition of the slider lock assembly 10 depicted in FIGS. 6 and 7, in which the male slider 11 can be drawn apart from the female slider 12 with a pull just strong enough to overcome the compression strength of the spring 25 in a manner already described.

Rotating the first dial 30 and/or the second dial 31 away from the above "unlock" position will shift their respective notches 30*a*, 31*a* out of registry or alignment with the bracket rib 26*b* and thereby bring the lock assembly 10 into "complete lock" position in which the lock prong 23 is non-rotatable and retained in locked engagement with the lock cavity 17*c*, prohibiting separation of the male slider 11 from the female slider 12. Since the lock tumbler 20 is vertically movable, the two sliders 11 and 12 can be readily coupled by thrusting the male wing extension 17 into the guide opening 18*c* and locked together immediately upon fitting engagement of the lock prong 23 with the lock cavity 17*a*.

Figure 10:
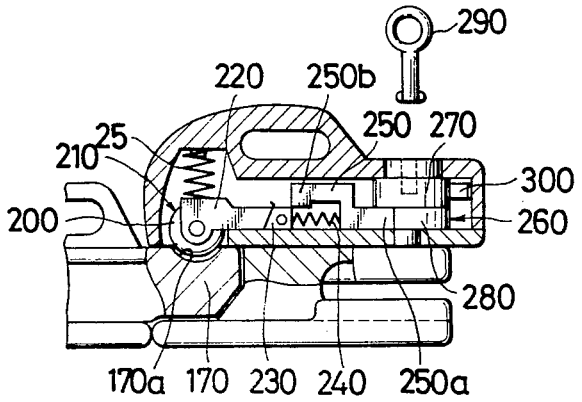
FIG. 10 is a side elevational, partly sectional view of a modified form of slider lock assembly embodying the invention which is key-operated.
Figure 11:
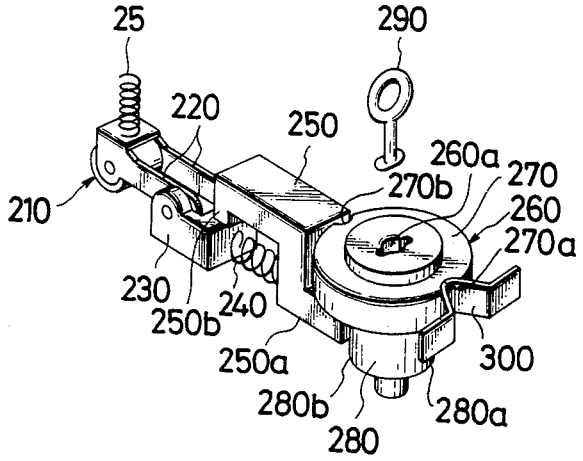
FIG. 11 is a perspective view on enlarged scale of the main operative parts of the lock assembly of FIG. 10.
Figure 12:
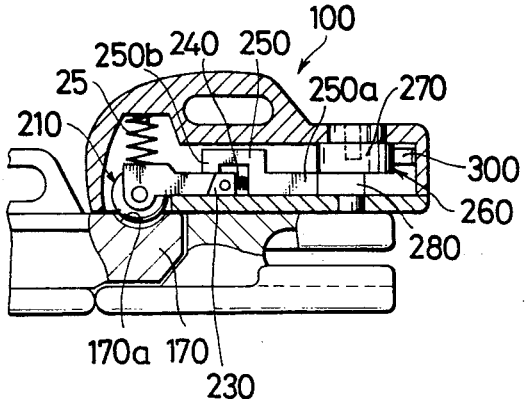
FIG. 12 is a view partly similar to FIG. 10 but showing the lock assembly locked.

FIGS. 10, 11 and 12, inclusive, shows a modified form of the slider lock assembly 10 according to the invention, in which there is provided a key-operated lock device in place of the dial device which has been already described. The key-operated lock assembly 100 is shown, including a portion of the male wing extension 170 which is provided in its upper surface with a relatively shallow, arcuately shaped lock cavity 170*a* corresponding to the cavity 17*a*, the remaining structural details of the male slider 11 being identical and hence omitted.

A tumbler 200 is in the form of a lock roller 210 rotatably connected to one end of a first bracket 220, the other end of which is pivotally connected to one end of a second bracket 230. The lock roller 210 takes the place of the lock prong 23 and is likewise normally urged by the spring 25 downwardly toward the guide opening 18*c*. The other end of the second bracket 230 is connected via a spring 240 to a crank arm 250 (corresponding to the slide bracket 26) having an elongated horizontal engaging portion 250*a* at one end and a finger portion 250*b* at the opposite end. The finger portion 250*b* is offset from the horizontal engaging portion 250*a* so that its end surface lies substantially flush with or slightly above the upper surface of the second bracket 230.

A key-operated latch 260 having a top-like configuration, as shown in FIG. 11, has a large-diameter disc 270 and a small-diameter cam disc 280 formed integrally but eccentrically with the disc 270. The cam disc 280 thus has a first peripheral portion 280*a* coextensive with the periphery of the large-diameter disc 270 and a second peripheral portion 280*b* offset from the periphery of the disc 270. The latch 260 is rotatably mounted in the casing 19 and has a key hole 260*a* in a portion of its upper surface which is exposed through the casing 19 for engagement with a key 290. The large-diameter disc 270 has a pair of diametrically opposed peripheral notches 270*a* and 270*b* which are adapted to receive the apex of a triangular leaf spring 300 secured to the inner wall of the casing 19.

Rotating the latch 260 with the key 290 in the hole 260*a* in one or the other direction for 180° will bring either of the two notches 270*a* and 270*b* into locking engagement with the leaf spring 300. When the latch 260 is rotated so as to register the notch 270*a* with the apex of the leaf spring 300 as shown in FIGS. 10 and 11, the crank arm 250 is positioned with its finger portion 250*b* held apart from the upper surface of the second bracket 230 and with its engaging portion 250*a* in abutting relation to the second peripheral portion 280*b* of the cam disc 280, in which position the slider lock assembly 10 is unlocked as the first bracket 220, hence the lock roller 210, is free to move away from the lock cavity 170*a*. By rotating the latch 260 another 180° until the opposite notch 270*b* engages the leaf spring 300, the lock assembly 10 is completely locked because the first peripheral portion 280*a* of the cam disc 280 faces and pushes the crank arm 250 toward the lock roller 210 against the tension of the spring 240 until the finger portion 250*b* rides on the first bracket 220 past the second bracket 230 and prohibits the upward movement of the lock roller 210, as shown in FIG. 12.

As shown in FIG. 6, the casing 19 is higher in level than the male slider 11 so that the pull tab 16 on the casing 19 lies in spaced parallel relation to and does not interfere with the pull tab 16 on the male slider 11, making them easy to be handled.

Figure 13:
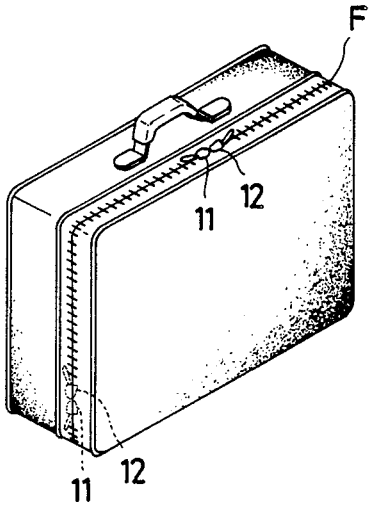
FIG. 13 is a diagrammatic perspective view of a suitcase to which a slide fastener with a pair of sliders is applied.

The compression strength of the spring 25 may be adjusted, as illustrated for example in FIG. 9, so as to overcome the sliding resistance of the sliders 11 and 12 thereby making it possible to conveniently interconnect the two sliders on the top of a suitcase and move them together while in provisional lock all way down and leave them on the side of the suitcase as illustrated in FIG. 13.

Obviously, various modifications and variations of the present invention are possible in the light of the above teaching. It is therefore to be understood that within the scope of the appended claims the invention may be practiced otherwise than as specifically described.

What is claimed is:

1. A slider lock assembly which comprises a pair of male slider and female slider each having an upper wing and a lower wing joined at one of their ends by a neck and defining therebetween a guide channel for the passage of a slide fastener, said ale slider having a wing extension forwardly of said neck and a lock cavity formed in the upper surface of said wing extension, and said female slider having an upper wing extension and lower wing extension extending in parallel with each other and defining therebetween a guide opening for receiving said male wing extension, a casing encompassing and attached to said upper wing of said female slider, a lock tumbler pivotally mounted in said casing to enter into and retract from said guide opening and adapted to engage with said cavity, a first spring normally urging said tumbler vertically toward said opening, a slide bracket mounted in said casing horizontally movably, a control means for selectively locking and unlocking said tumbler and a second spring normally urging the latter horizontally toward said tumbler.

2. A slider lock assembly according to claim 1 wherein said control means is a dial device rotatably mounted in said casing.

3. A slider lock assembly according to claim 1 wherein said lock cavity increases in depth progressively toward the leading end of said wing extension.

4. A slider lock assembly according to claim 1 wherein said lock tumbler has a lock prong shaped in conformity with said lock cavity.

5. A slider lock assembly according to claim 1 wherein said male wing extension has an upwardly canted cam surface at its lower leading end.

6. A slider lock assembly according to claim 1 wherein said tumbler has an integral transverse pin received in vertically elongated slots formed in opposite side walls of said casing so that said tumbler can both rotate and linearly move in said slots.

7. A slider lock assembly according to claim 1 wherein said bracket has an upwardly protruding rib engageable with a peripheral notch formed in said dial.

8. A slider lock assembly according to claim 1 further including a roller lock tumbler, a crank arm adapted to releasably lock said tumbler against vertical movement and a key-operated latch having an eccentric cam disc engageable selectively at two diametrically opposed positions with said crank arm.

9. A slider lock assembly according to claim 1 further including a means adapted to adjust the compression strength of said spring.

10. In a slider lock assembly including a male slider and a female slider, said female slider including a casing and being adapted to receive a wing extension of said male slider in selective locking engagement, a locking-/latching mechanism disposed in said casing and comprising the following:

tumbler means, vertically movable and pivotable within said housing, for engaging a recess in said wing extension of said male slider; and slide bracket means, horizontally movable within said housing, for selectively permitting or prohibiting pivoting of said tumbler means.

* * * * *